United States Patent [19]

Gold

[11] 4,144,686

[45] Mar. 20, 1979

[54] METALLIC BEAMS REINFORCED BY HIGHER STRENGTH METALS

[76] Inventor: William Gold, 14 Cass Pl., Brooklyn, N.Y. 11235

[21] Appl. No.: 810,065

[22] Filed: Jun. 27, 1977

Related U.S. Application Data

[63] Continuation-in-part of Ser. No. 165,131, Jul. 22, 1971, abandoned.

[51] Int. Cl.[2] ..... E04C 3/10

[52] U.S. Cl. ..... 52/225; 52/73; 52/223 R; 52/223 L

[58] Field of Search ..... 52/720, 721, 263, 225, 52/73, 223 R

[56] References Cited

U.S. PATENT DOCUMENTS

| | | | |
|---|---|---|---|
| 1,537,589 | 5/1925 | Dawson et al. | 52/223 R |
| 1,770,932 | 7/1930 | Leake | 52/225 X |
| 2,364,221 | 12/1944 | Kass | 24/136 R |
| 2,373,072 | 4/1945 | Wichert | 52/223 R X |
| 2,382,139 | 8/1945 | Cueni | 52/223 R X |
| 2,510,958 | 6/1950 | Coff | 52/225 |
| 2,601,910 | 7/1952 | Nichols | 52/223 R |
| 2,675,695 | 4/1954 | Coff | 52/225 |
| 2,930,642 | 3/1960 | Howlett | 403/314 |
| 3,010,257 | 11/1961 | Naillon | 52/225 |
| 3,140,764 | 7/1964 | Cheskin | 52/693 X |
| 3,399,434 | 9/1968 | Kelly | 403/369 X |

FOREIGN PATENT DOCUMENTS

| | | | |
|---|---|---|---|
| 301716 | 12/1954 | Switzerland | 52/223 R |
| 973858 | 10/1964 | United Kingdom | 52/263 |

*Primary Examiner*—Alfred C. Perham

[57] ABSTRACT

A metallic beam, reinforced and prestressed by a cable means, to form a composite structure, the cable means extending longitudinal, along the beam's tensioned part, continuously, to both sides of the beam's section of maximum positive design moment, or its section of maximum negative design moment, or both.

A metallic rigid frame, reinforced and prestressed by a cable means, to form a composite structure, the cable means extending longitudinal, along the frame's knee and, continuously, to both sides of it, along the tensioned part of the frame.

In all cases, the forces of the cable means are transferred to the beam or frame by at least three anchor means, attached to the beam or frame, respectively, and gripping the cable means.

At least one interior anchor means is either in the form of a sleeve, swaged to the cable means, or a cable clamp; or a sleeve into which wedges have been driven; or a socket filled with a solidified material, such as zinc.

The use of a guiding means, to change the direction of the cable means, is optional when this change is desired.

24 Claims, 17 Drawing Figures

INVENTOR.
WILLIAM GOLD

INVENTOR.
WILLIAM GOLD

METALLIC BEAMS REINFORCED BY HIGHER STRENGTH METALS

This is a continuation-in-part of my application Ser. No. 165,131 filed July 22, 1971, now abandoned.

This invention deals with metallic beams reinforced and prestressed by tendons which, usually, are of higher strength metals than those of the beams they reinforce. The beam is either a truss, or a girder, or a rolled section, or one of these members connected to the slab it supports, to form a composite member. The tendon can be a wire, or wire strand, or a wire strand cable, or a high strength bar, or any member or combination of members capable of resisting tension. These prestressed beams can be employed in bridges and buildings.

At present, with metallic prestressed beams, only the ends of each tendon are anchored (connected) to the beam they reinforce. Straight tendons rest, at intermediate points, on supports such as stiffners. Draped tendons are deflected by supports, such as pins or saddles.

This invention consists of anchoring the tendons to the beam they reinforce, not only at the ends of the tendons, but also at some of their intermediate points. This type of construction can render the tendons fully composite with trusses, and partly composite with girders and rolled sections. This type of structure (member) is more rigid than present day metallic prestressed beams. Further, using interior anchoring means (connectors), in addition to the end ones, makes possible the use of lighter anchoring means, than are employed at present for the same prestressing force. Further, with the use of intermediate anchoring means, it is no longer necessary that each tendon be of constant cross section throughout its entire length, but can change its cross section at an intermediate anchoring means.

The principle aim of this invention, however, is safety, particularly with welded structures. For instance, if there is a weld failure of the bottom flange of a simply supported beam, prestressed in accordance with this invention, and the tendon (or tendons) can take up the additional tension, the ensuing elongation of the above tendon would be a fraction of the tendon's elongation, caused by the failure in beams prestressed by present day methods, since the distance between the anchor means which straddle the point of failure, in the case of this invention, is smaller than the total length of the tendon. Thus, this invention reduces the deflection, the stresses in the web and in the top flange, in case of the above failure.

There is another safety factor, in this invention. In case of slippage or failure of an interior anchor means, the anchor means straddling it, will take up the force released by the failure. If a single tendon had been used, lateral twisting, due to the failure, does not take place. Needless to say, this invention renders the use of a single tendon more feasible than present day methods do.

With the aid of the accompanying drawings, the invention will become clearer. Similar members will have the same numerical notation.

Figure 1:
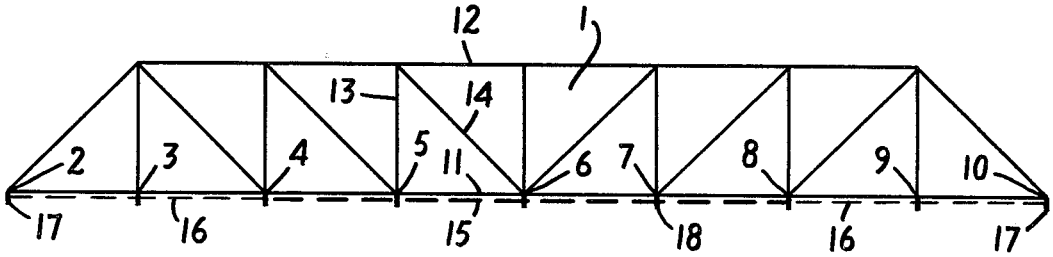
FIG. 1 is the elevation of a symmetrical metallic Pratt truss, reinforced and prestressed by one or more strands.

In FIG. 1, 1 is the truss, with bottom joints 2 to 10 inclusive; 11 is the bottom chord, 12 the top chord, 13 the verticals, and 14 the diagonals. The truss is reinforced and prestressed by tendon 15- a wire strand in this case- which extends beyond joints 4 and 8, as a strand of reduced diameter 16. Strand 15 is connected to truss 1 by means of anchor means 18 at bottom joints 4 to 8 inclusive, and strands 16 are connected to the truss by anchor means 17 at joints 2 and 10, as well as at joints 3 and 9.

Another possibility is to use a plurality of strands. In this case 15 would represent a larger number of strands than does 16.

Figure 2:
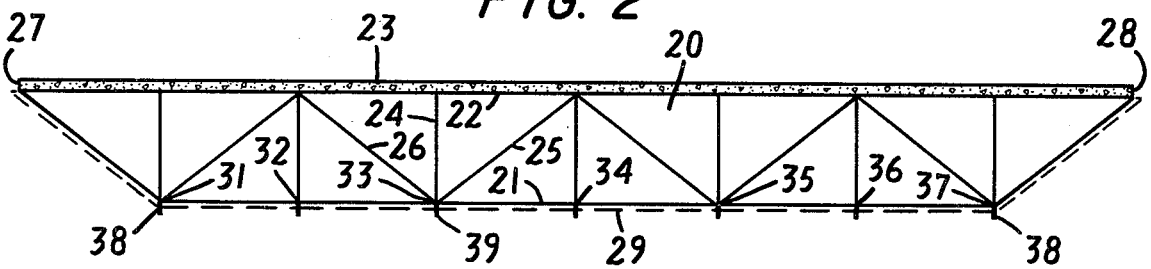
FIG. 2 is the elevation of a symmetrical metallic Warren truss, supporting a concrete slab. The truss is reinforced and prestressed by a strand.

In FIG. 2, 20 is the truss, 21 its bottom chord, 22 its top chord, supporting slab 23,24 are the truss' verticals; 25 are the compression diagonals, and 26 are the tension diagonals. The truss is supported at 27 and 28. The bottom joints are marked 31 to 37 inclusive.

The truss is prestressed and reinforced by means of wire strands 29. Each of these strands is gripped by end (exterior) anchor means 38 and by the interior anchor means 39. the end anchor means are attached to the bottom chord (21) at joints 31 to 37 and the interior (intermediate) anchor means are attached to the bottom chord at joints 32 to 36 inclusive.

Figure 3:
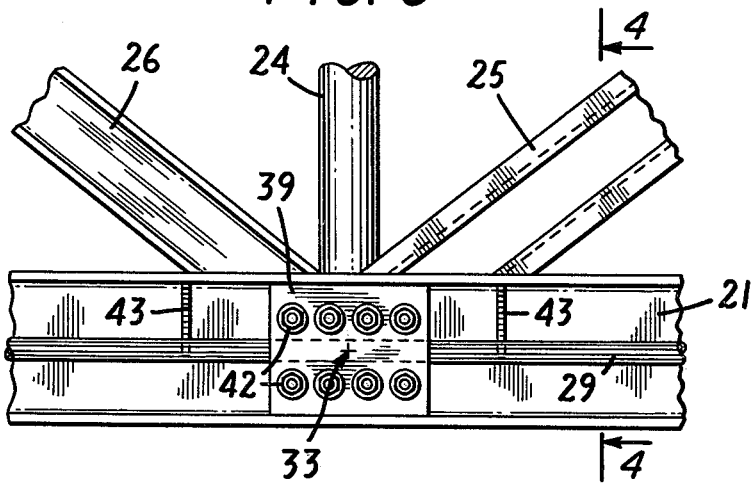
FIG. 3 is the elevation of joint 33 of the truss of FIG. 2.
Figure 4:
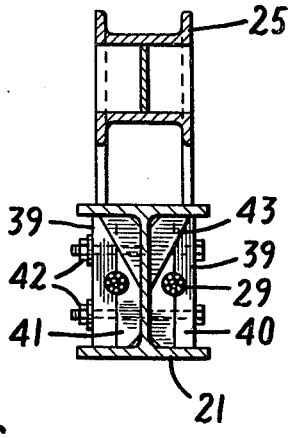
FIG. 4 is section 4—4 of FIG. 3.

In FIG. 3 and FIG. 4, the tendons (in this case wire strands) 29 are gripped by anchor means 39. Each of these anchor means is made of two parts 40 and 41, pressed together by bolts 42. These bolts are common to both anchor means 39, and go through holes in the web of chord 21. Thus they can also transmit load from the anchor means to the chord.

This structure has the advantage that no field welding is required in attaching the tendons (29) to the truss. The disadvantage is that during the normal life span of such a structure, bolts 42 have to be tightened at least twice.

A modification of this construction is to have each anchor means 39 clamped together by separate bolts- which do not go through the web of 21- and to have each interior part of 39, namely 41, welded to chord 21.

Of course 39 is a clamp. Here too, no field welding is required.

Figure 5:
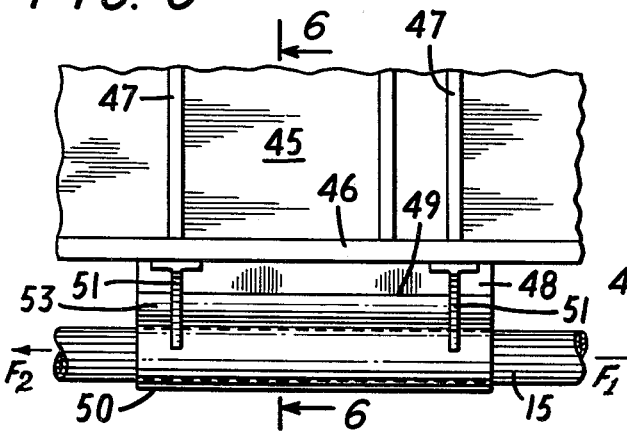
FIG. 5 is the fractional elevation of the bottom of a plate girder, at an interior anchor means. The girder is prestressed and (incompletely) composite with a tendon.
Figure 6:
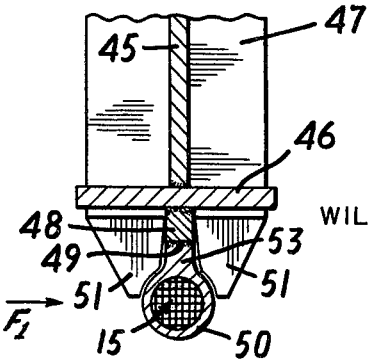
FIG. 6 is section 6—6 of FIG. 5.

In FIG. 5 and FIG. 6, 45 is part of a web plate of a plate girder. 46 is part of the bottom flange, 47 part of a stiffner. To the bottom flange is attached, preferably shop welded, lug 48. Tendon 15 is gripped by anchor means 50, preferably by swaging (the anchor means to the strand). When the strand (tendon) is ready to be attached to the girder, the anchor means' extension 53 is welded to lug 48 along surface 49. The height of lug 48 should be sufficient to prevent the heat of this welding from affecting significantly the stresses in flange 46, and the height of extension 53 should be sufficient to prevent the heat of this welding from affecting significantly the gripping force of anchor means 50, and the allowable stress of tendon 15. 51 is a lateral support (for 50), tack welded to flange 46.

$F_1$ and $F_2$ are the forces in the tendon, on the right side, and on the left side of the anchor means, respectively. Force = $F_1$ minus $F_2$ ($F_1-F_2$), is taken up by anchor means 50 and transmitted to the girder.

When the prestressing procedure involves the tensioning of the tendon, without the stressing of the girder (as is the case in pre-tensioning of concrete members), lugs 48 can be omitted, and extension 53 welded, at its surface 49, to the flange. Obviously anchor means 50 is a sleeve with an extension.

Figure 7:
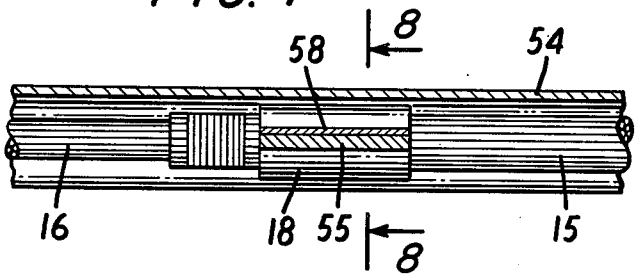
FIG. 7 is the sectional elevation of a bottom chord of a truss, or of a bottom flange of a plate girder, at an interior anchor means, of the prestressing tendon.
Figure 8:
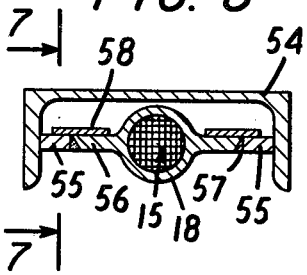
FIG. 8 is a section 8—8 of FIG. 7.

In FIG. 7 (which is also section 7—7 of FIG. 8), and FIG. 8, 54 is a channel. To it are attached, preferably shop welded, lugs 55. Tendon 15 is gripped by anchor means 18, which is a sleeve with two extensions (projections) 56. By welding these extensions to lugs 55, at surfaces 57, tendon 15 is attached to flange 54. 58 is a backup piece.

Here again the width of lug 55 should be sufficient to prevent the heat of the welding, at 57, from affecting significantly the stresses in 54, and the width of projection 56 should be sufficient to prevent the heat of this welding from affecting significantly the gripping force of anchor means 18, as well as the allowable stress of tendon 15, which is a wire strand. Here, again, anchor means 18 is swaged to tendon 15.

Figure 9:
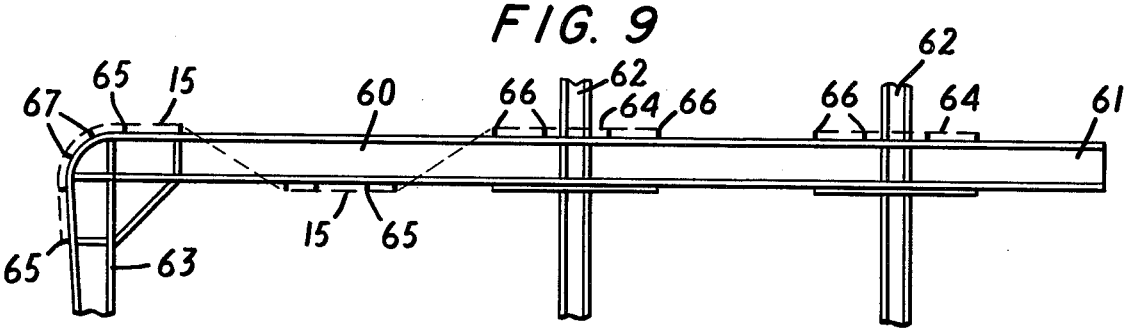
FIG. 9 is the elevation of a rigid frame, reinforced and prestressed by tendons- schematically represented.
Figure 10:
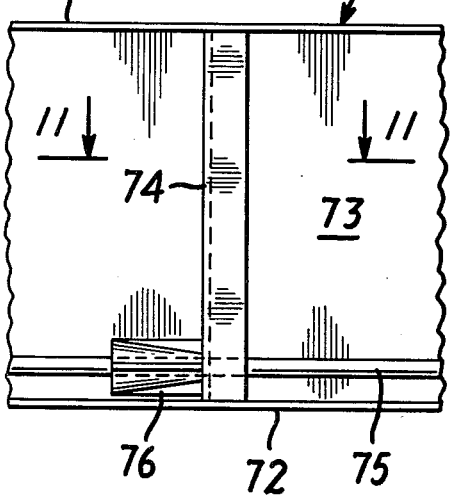
FIG. 10 is the elevation of part of a plate girder, at an interior anchor means. This scheme is an alternate to those shown on FIGS. 5 and 7.
Figure 11:
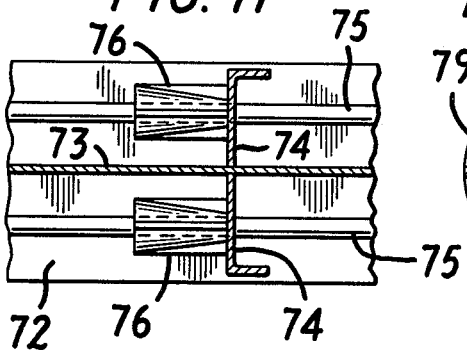
FIG. 11 is section 11—11 of FIG. 10.
Figure 14:
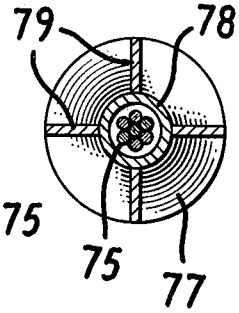
FIG. 14 is section 14—14 of FIG. 12.

In FIG. 9, 60 is a beam, continuous over columns 62, and rigidly connected to column 63. The beam extends to contilever 61. The tension sides of sections of the beam and of column 63, subjected to high moments, prestressed and reinforced by tendons 64 and 15 respectively. 65 and 66 are anchor means; 67 is a guiding means for tendons 15. Tendons 64 are placed on both sides of the top flange of beam 60. One structure, of the latter type, can be produced by welding a lug, similar to 48, of FIGS. 5 and 6, to each edge of the flange, and one anchor means, similar to 50 (FIGS. 5 and 6), with extension 53, in a horizontal position, is welded, along surface 49, to the above lugs. Each of these anchor means is gripping a tendon 64. Thus there is a tendon on each side of the flange, with the lateral center line of the flange passing through the centers of these tendons. Of course these anchor means line up laterally. In other words, the lateral center lines of these anchor means are on a line perpendicular to the longitudinal axis of the beam. Thus, in FIG. 9, each anchor means 66 is a sleeve, similar to 50, attached to a lug, similar to 48, which is attached to the edge of the beam's flange.

It should be noted that here, as in the case of FIGS. 5 and 6, lugs 48 are, preferably, welded to the flange of the beam (or girder) before the beam (or girder) is stressed, thus avoiding Welding a stressed member. Further, in the prestressing procedure, when the stresses in the tendon and the beam (or girder), have the required values, for the prestressing, at an anchor means, the latter is welded to lug 48.

For tendon 15, in FIG. 9, the attachment to the beam can be similar to the arrangement shown on FIGS. 5 and 6, and to the procedures associated with them.

It should be noted that the attachment of tendon to flange or chord, in FIGS. 7 and 8, can also be similar to the procedures associated with FIGS. 5 and 6, in this respect.

In FIGS. 10 to 17 inclusive, similar members have the same numerals.

In FIGS. 10, 11, 12, 13 and 14, 70 is a plate girder with top flange 71 and bottom flange 72. 73 is the web plate; 74 a stiffner. The girder is prestressed and composite with tendons 75. 76 is the anchor means connecting tendon to girder. It consists of a case (sleeve) which grips the tendon by means of wedges driven between the tendon and the internal wall of the case- 77- a hollow truncated cone, which extends into hollow cylinder 78. 79 is a longitudinal flange, which may be attached to the case, but is preferably integral with it. Anchor means 76 has four longitudinal flanges. Each wedge 80 is an arcuate elongated tapering segment, with teeth 81 on its inner surface. Details of such an "anchor", its assembly and internal stress are known, and do not require explanation here. References are supplied, at the conclusion of this patent. Suffice to say that when the total tension in the tendon, at the right side of the "anchor" (76) is $F_1$, and at its left side $F_2$, the difference between these forces ($F_1-F_2$) is taken up by the "anchor" and transmitted to the girder by flanges 79 which abut against stiffner 74.

Tendon 75 is shown as a parallel wire strand.

Figure 17:
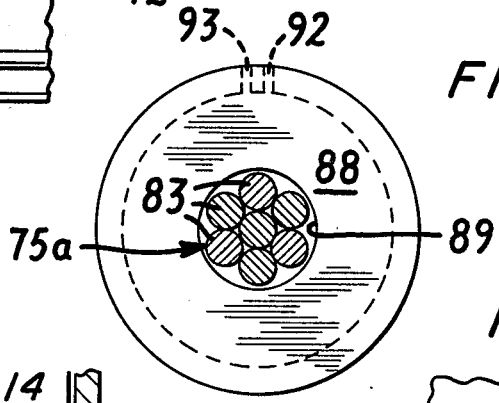
FIG. 17 is section 17—17 of FIG. 15.
Figure 15:
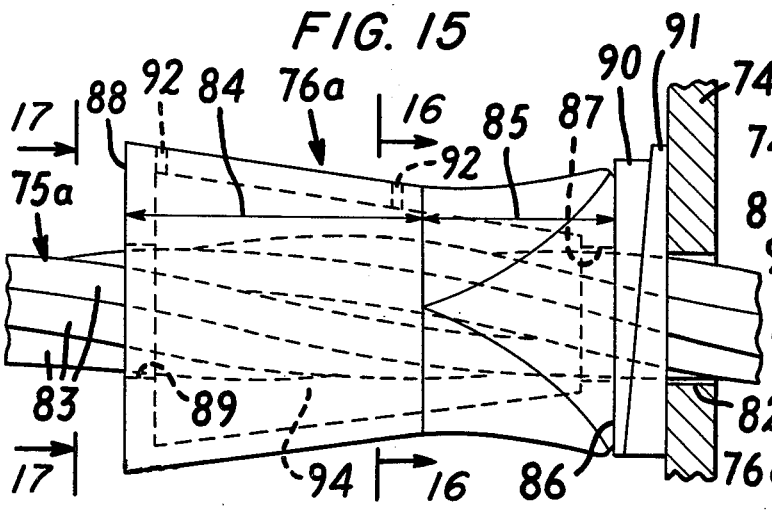
FIG. 15 is the elevation of a socket gripping a strand by means of the material filling the socket. It represents an interior anchor means.
Figure 16:
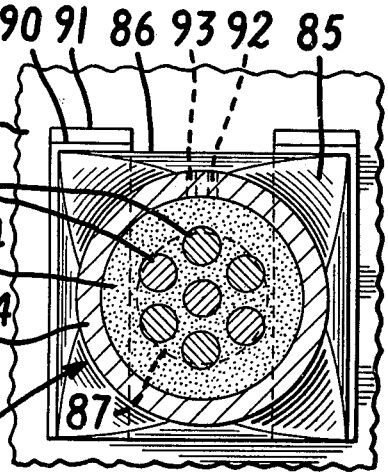
FIG. 16 is section 16—16 of FIG. 15.

In FIGS. 15, 16 and 17, **76*a* is an interior anchor means which consists of socket 84–85, the interior surface of which is frustro Its exterior surface, for part 84 is parallel to its interior surface, and for part 85, it gradually varies from a circular cross section to a rectangular one, at its exterior end. End wall 86 has opening 87, and end wall 88 has opening 89. These openings are large enough to allow tendon 75*a*** through. Here the tendon is a twisted wire strand.

The basic procedure to attach the socket to the strand is to position the latter in the socket; then to grip the strand, at both ends of the socket, and rotate these section in opposite directions, to twist the strand, between these sections, in the direction opposite the direction of the twist of the strand. This will cause wires 83, of strand **75*a*, to move away from each other, between the rotated sections, as shown on FIGS. 15 and 16. With the wires in this position, a material, in liquid state, is poured into the socket, through holes 92, to fill the remaining spaces in the socket. Subsequently, the material- 94- solidifies, to grip wires 83, and the torque on the strand, is released. Additional details of this procedure are not described here, for they can be similar to those employed in the attachment of zinc filled sockets to ends of strands, and this technique is known. The steel companies' handbooks for wire ropes are good references, for the latter technique. Holes 93** are air escapes.

Figure 12:
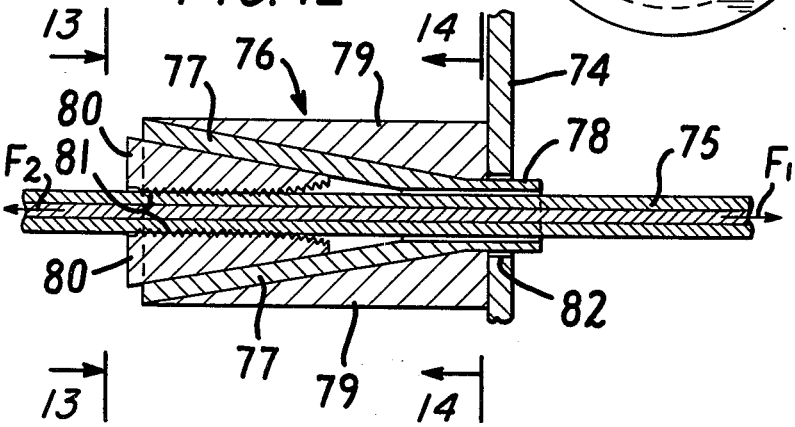
FIG. 12 is the longitudinal vertical section through the anchor means, and one of the prestressing tendons of FIG. 10.
Figure 13:
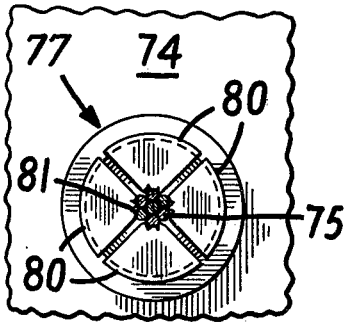
FIG. 13 is section 13—13 of FIG. 12.

This socket can replace socket 76 of FIG. 12. However, here the socket had been attached to the strand before the latter had been tensioned, for prestressing the girder. Upon tensioning the strand, there is a space between the socket's wall 86 and stiffner 74. In this space wedges 90 and 91 are placed. Thus the force, taken up by the socket, from strand 75*a*, is transmitted to the girder through the wedges.

When material 94 is zinc, it is poured into the socket in a molten state, and then upon cooling, it solidifies.

Perhaps other materials can replace the zinc.

The drawings and their description, present a few preferred embodiments of this invention, and a few alternatives. They are not limiting, but serve also as examples of the application of this invention. Modifications can be made in them, and other structures can be designed without departing from the spirit and scope of this invention. A few example follow.

Tendons need not be, longitudinally, straight. They may be draped. For instance, in FIG. 2, tendon 29 can be extended, diagonally, beyond anchor means 38, to be finally "anchored" at 27 and 28.

In FIGS. 1 and 2, the anchor means are shown at the joints of the lower chord. This is preferable, but not always. For instance, the lower chord 21 can be extended beyond points 38, and to this extension tendon 29 can be "anchored" (attached).

The prestressing of a continuous beam by tendons which prestress both at least one section of it, subjected to positive moments, and at least one section of it, subjected to negative moments, is known. In such a case, in accordance with this invention, such a tendon would be connected to the beam by two end anchor means, and by at least one interior anchor means.

When a plurality of tendons is used, they may be connected (anchored) to the member they prestress and reinforce, by at least one anchor means which grips them all, along a line approximately perpendicular to the longitudinal axis of the member.

The methods of prestressing structural members, as well as the stresses involved, are known. Therefore they have not been discussed here. Only one observation could be made. In accordance with this invention, tendons need not have always the same stress along their entire length. For instance, in FIG. 2 tendon 29 may have a given prestressing force between the anchor means at joints 35 and 39, and a lower prestressing force, between the anchor means at joints 31 and 33 as well as between the anchor means at joints 35 and 37.

In accordance with this invention, the prestressing force in tendons can be zero. Thus, these tendons are reinforcement.

Needless to say, the tendon shown on FIG. 3 can be a bar; the tendon shown on FIG. 5 can be a strand of twisted wires; the anchor means of FIG. 15 could be a swaged sleeve, and so on.

The basic concept of this invention had been stated in this specification.

In the claims, a beam means a rolled section, or a plate girder, or a girder of any construction, such as with at least one flange being a rolled section, a truss, a box girder (including triangular shaped ones), a pipe, or any combination of the above beams. A beam may or may not be composite with the slab or plate or floor it carries.

A tendon is a tension member, such as a wire, or a wire strand, or a wire rope, or a cable, or a rod. In the claims a tendon is referred to as a "cable means."

Prestressing forces in the cable means have been discussed in this specification. It should be added, that in one or more sub-spans of a cable means, the prestressing force may be zero, or negligibly negative, while the remainder of the cable means is stressed.

In the claims, attaching an anchor means to a beam, means attaching it directly to the beam, or to a member connected to the beam, such as a stiffner or a lug (FIGS. 5 and 7). Abutting against a member is also considered an attachment to the member.

I claim:

1. A prestressed and composite metallic beam, comprising a metallic beam, resting on two supports, a cable means and at least three anchor means, which are attached to the beam, and grip the cable means, of these anchor means, at least one interior anchor means grips the cable means, at least in part, by exerting on it pressure from a plurality of opposite directions, the cable means extends, essentially, longitudinal with respect to the beam, for at least part of the latter's length, and at least part of the cable means' length is situated adjacent to the beam's tensioned part, preferably its tensioned flange, continuously to both sides of the beam's section of maximum positive moment, the anchor means transfer to the beam the forces of the cable means, including its prestressing forces.

2. The beam described in claim 1 wherein a guiding means is attached to the beam and butts laterally against the cable means, to change the latter's direction.

3. The beam, described in claim 1, wherein said interior anchor means is in the form of a sleeve, swaged to the cable means.

4. The beam, described in claim 1, wherein said interior anchor means is in the form of a cable clamp, comprised of two parts, pressed together by bolts, gripping the cable means.

5. The beam described in claim 1, wherein said interior anchor means is in the form of a sleeve, containing a section of the cable means, and at least one wedge, forced between the cable means and the interior surface of the sleeve.

6. The beam described in claim 1, wherein said interior anchor means is in the form of a socket, containing a section of the cable means, and filled with a solidified material, such as zinc.

7. A prestressed and composite metallic beam, comprising a metallic beam, resting on at least three supports, a cable means and at least three anchor means, which are attached to the beam and grip the cable means, of these anchor means, at least one interior anchor means grips the cable means, at least in part, by exerting on it pressure from a plurality of opposite directions, the cable means extends essentially longitudinal with respect to the beam, for at least part of the latter's length, and at least part of the cable means' length is situated adjacent to the beam's tensioned part, preferably its tensioned flange, for at least part of at least one of the beam's spans, continuously to both sides of the span's section of maximum positive moment, the anchor means transfer to the beam the forces of the cable means, including its prestressing forces.

8. The beam described in claim 7, wherein said interior anchor means is in the form of a sleeve, swaged to the cable means.

9. The beam described in claim 7, wherein said interior anchor means is in the form of a cable clamp, comprised of two parts, pressed together by bolts, gripping the cable means.

10. The beam described in claim 7, wherein said interior anchor means is in the form of a sleeve, containing a section of the cable means, and at least one wedge, forced between the cable means and the interior surface of the sleeve.

11. The beam described in claim 7, wherein said interior anchor means is in the form of a socket, containing a section of the cable means, and filled with a solidified material, such as zinc.

12. The beam described in claim 7, wherein a guiding means is attached to the beam and butts laterally against the cable means, to change the latter's direction.

13. A prestressed and composite metallic beam, comprising a metallic beam, resting on at least one support, a cable means, and at least three anchor means, which are attached to the beam, and grip the cable means, of these anchor means, at least one interior anchor means grips the cable means, at least in part, by exerting on it pressure from a plurality of opposite directions, the cable means extends, essentially longitudinal with respect to the beam, for at least part of the latter's length, and situated adjacent to the beam's tensioned part, preferably its tensioned flange, continuously to both sides of the support, for at least part of the length of each of the spans, adjacent to the support, the anchor means transfer to the beam the forces of the cable means, including its prestressing forces.

14. The beam described in claim 13, wherein said interior anchor means is in the form of a sleeve, swaged to the cable means.

15. The beam described in claim 13, wherein said interior anchor means is in the form of a cable clamp, comprised of two parts, pressed together by bolts, gripping the cable means.

16. The beam described in claim 13, wherein said interior anchor means is in the form of a sleeve, containing a section of the cable means, and at least one wedge forced between the cable means and the interior surface of the sleeve.

17. The beam described in claim 13, wherein said interior anchor means is in the form of a socket, containing a section of the cable means, and filled with a solidified material, such as zinc.

18. The beam described in claim 13, wherein a guiding means in attached to the beam and butts laterally against the cable means, to change the latter's direction.

19. A prestressed and composite metallic rigid frame, comprising a metallic beam, a metallic column, a cable means, and at least three anchor means, which are attached to the frame, and grip the cable means, of these anchor means, at least one interior anchor means grips the cable means, at least in part, by exerting on it pressure from a plurality of opposite directions, the cable means extends, essentially, longitudinal with respect to the beam, for at least part of the latter's length, the cable means further extends along a curve, and extends further, essentially, longitudinal with respect to the column, for at least part of the latter's length, at least part of the length of each of these segments of the cable means are situated adjacent to the tensioned parts, preferably the tensioned flanges, of the members along which they extend respectively, the anchor means transfer to the frame the forces of the cable means, including its prestressing forces.

20. The rigid frame, described in claim 19, wherein said interior anchor means is in the form of a sleeve, swaged to the cable means.

21. The rigid frame, described in claim 19, wherein said interior anchor means is in the form of a cable clamp, comprised of two parts, pressed together by bolts, gripping the cable means.

22. The rigid, frame described in claim 19, wherein said interior anchor means is in the form of a sleeve, containing a section of the cable means, and at least one wedge, forced between the cable means and the interior surface of the sleeve.

23. The rigid frame, described in claim 19, wherein said interior anchor means is in the form of a socket, containing a section of the cable means, and filled with a solidified material, such as zinc.

24. The rigid frame described in claim 19, wherein a guiding means is attached to the frame and butts laterally against the cable means, to change the latter's direction.

* * * * *

UNITED STATES PATENT AND TRADEMARK OFFICE

CERTIFICATE OF CORRECTION

PATENT NO. : 4,144,686

DATED : March 20, 1979

INVENTOR(S) : William Gold

Figure 18:
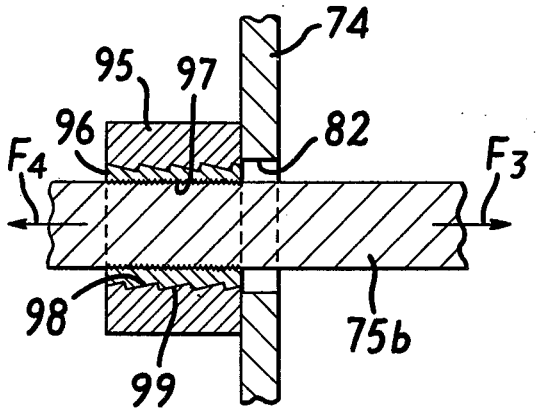
Figure 19:
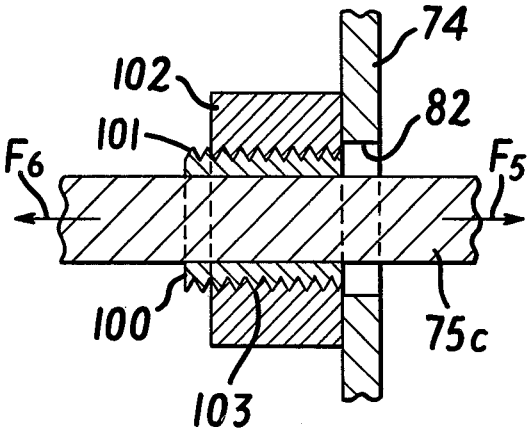

It is certified that error appears in the above-identified patent and that said Letters Patent are hereby corrected as shown below:

The sheet of drawing showing Figures 18 and 19 should be omitted.

Column 4, lines 37-38, "the interior surface of which is frustro." should read -- the interior surface of which is frusto-conical. -- .

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*